US006755696B1

(12) United States Patent
Ko

(10) Patent No.: US 6,755,696 B1
(45) Date of Patent: Jun. 29, 2004

(54) ELECTRICAL CONNECTOR WITH IMPROVED TERMINAL RETENTION MEANS

(75) Inventor: David Tso-chin Ko, Thousand Oaks, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 10/413,893

(22) Filed: Apr. 14, 2003

(51) Int. Cl.[7] ..... H01R 13/432
(52) U.S. Cl. ..... 439/746
(58) Field of Search ..... 439/746, 747, 439/748, 749, 871, 872, 752.5, 744, 745, 884, 839, 877

(56) References Cited

U.S. PATENT DOCUMENTS 4,329,009 A 5/1982 Bungo
4,781,628 A 11/1988 Detter et al.
4,784,623 A * 11/1988 Beck, Jr. ..... 439/872
4,979,912 A 12/1990 Shindo et al.
5,266,056 A 11/1993 Baderscjmeoder et al.
5,354,218 A 10/1994 Fry et al.
5,913,695 A 6/1999 Okabe
6,165,026 A * 12/2000 Sugie et al. ..... 439/748

* cited by examiner

*Primary Examiner*—Ross Gushi
(74) *Attorney, Agent, or Firm*—Wei Te Chung

(57) ABSTRACT

An electrical connector (1) includes a dielectric housing (10) defining a pair of passageways (12) therehrough and a pair of conductive terminals (50) held in the passageways, respectively. The conductive terminal includes a slim pin (52) for mating with a receptacle contact of a complementary connector, a crimping portion (54) for crimping a conductive wire and a retention portion (58) between the slim pin and the crimping portion. The retention portion has an off-center latch tang (66) rearwardly extending from a half of the retention portion. The off-center latch tang is engageably received in an off-center recess (78) of the passageway and the other half of the retention portion is borne by a block (80) of the dielectric housing to prevent the conductive terminal swiveling in the passageway.

7 Claims, 7 Drawing Sheets

ELECTRICAL CONNECTOR WITH IMPROVED TERMINAL RETENTION MEANS

BACKGROUND OF THE INVENTION

1. Field of the Invention

The present invention relates to an electrical connector having improved terminal retention means for reliably retaining conductive terminals thereof in passageways of a dielectric housing thereof.

2. Description of Prior Art

A wide variety of mating electrical connectors employ pairs of interengaging pin socket terminals for interconnecting a plurality of circuits or wires through the mated connectors. The pin and socket terminals often are called male and female terminals, respectively.

The terminals are mounted in a plurality of terminal receiving passageways of a dielectric housing of the electrical connector. The terminals generally are elongated and are inserted into the passageways along the longitudinal axes of the terminals. Some form of latch means normally are provided to hold the terminals in the passageways against withdrawal therefrom. For instance, the terminals often are provided with outwardly projecting, cantilevered flexible latch arms which snap behind shoulders within the terminal-receiving passageways of the dielectric housing.

However, in order to have any significant latching capabilities, these latch arms must be of a sufficient width and the dielectric housing must define a recess of at least a same width for receiving the latch arms which often renders the dielectric housing having very little material to snap the body portions of the conductive terminals. So, the conductive terminals may swivel in the passageways along central axis thereof, these will disturb the engagement of the conductive terminals with mating contacts of a complementary connector.

Hence, an electrical connector with an improved terminal retention means is desired to overcome the above-mentioned disadvantages.

SUMMARY OF THE INVENTION

Accordingly, an object of the present invention is to provide an electrical connector having improved terminal retention means for securely retaining conductive contacts thereof in passageways of a dielectric housing thereof.

To fulfill the above-mentioned objects, an electrical connector includes a dielectric housing defining a pair of passageways therethrough in a rear-to-front direction thereof, and a pair of conductive terminals received in the passageways. The conductive terminal includes a front portion adapted for mating with a conductive contact of a complementary connector, a rear portion having crimp tabs for electrically crimping a conductive wire and a middle portion between the front and rear portions. The middle portion has an upper strap section adjacent the front portion and an off-center latch tang extending upwardly and from the upper strap section toward the rear portion. The off-center latch tang offsets from a central axis of the conductive terminal. The passageways of the dielectric housing each include an off-center recess offsetting from the central axis of the conductive terminal. The off-center latch tang of the conductive terminal is received in the off-center recess and a free end thereof bears against the housing, and the upper strap section of the conductive terminal bears against the housing.

Other objects, advantages and novel features of the invention will become more apparent from the following detailed description when taken in conjunction with the accompanying drawings.

DETAILED DESCRIPTION OF THE INVENTION

Referring to FIGS. 1–8, an electrical connector 1 includes a dielectric housing 10 defining a pair of passageways 12 therethrough in a rear-to-front direction "R" thereof, and a pair of conductive terminals 50 (only one is shown) respectively received in the passageways 12 of the dielectric housing 10.

Figure 1:
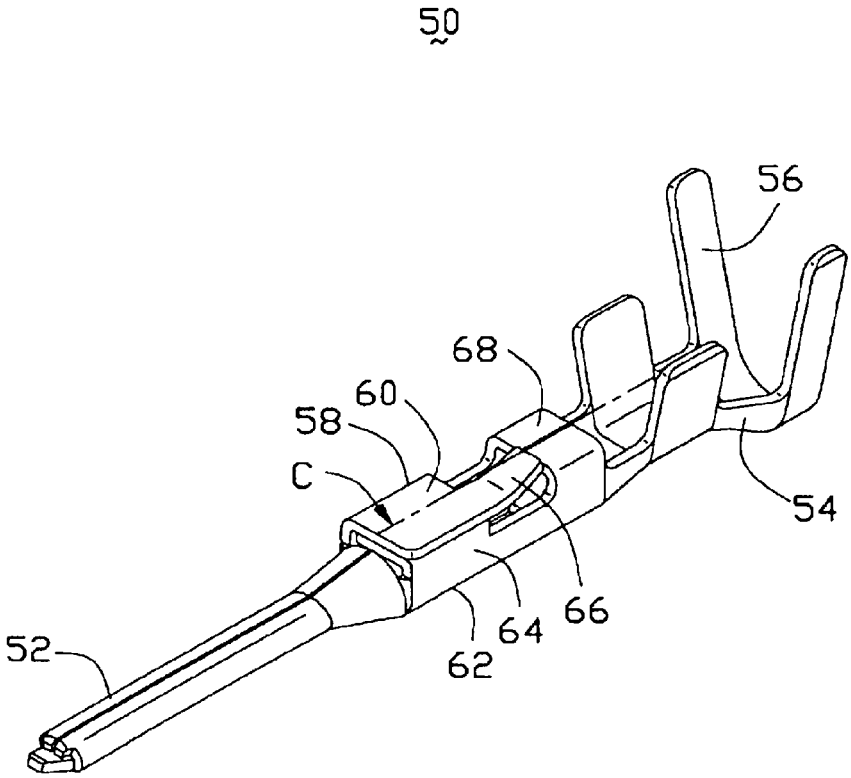
FIG. 1 is a perspective view of a conductive terminal of an electrical connector of the present invention.
Figure 2:
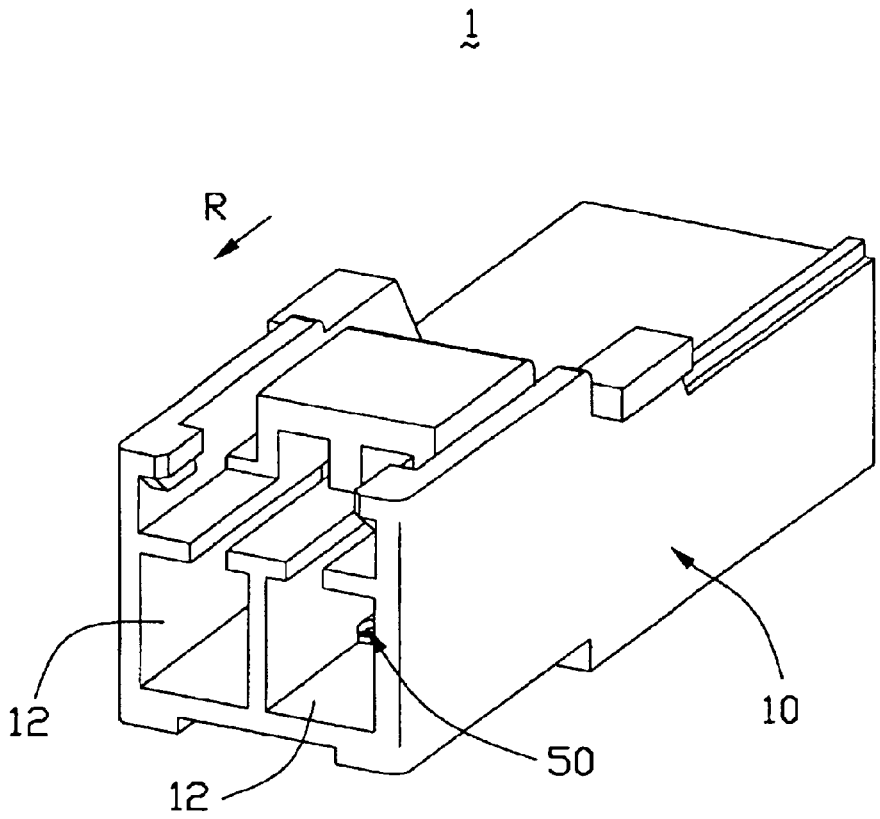
FIG. 2 is a perspective view of the electrical connector of the present invention.
Figure 3:
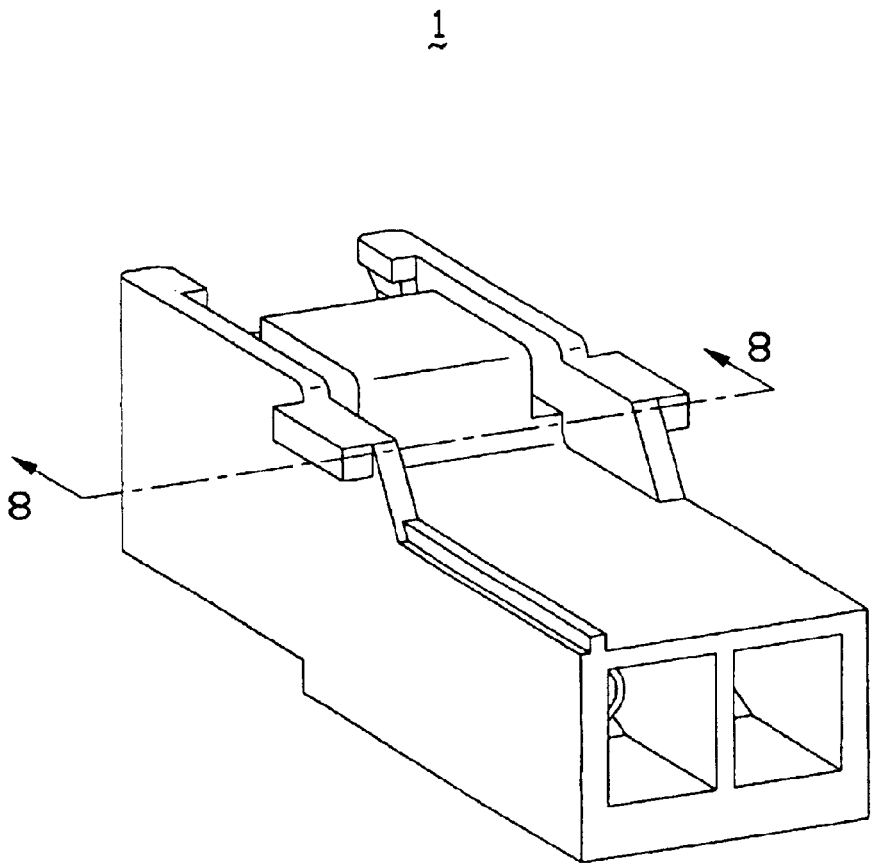
FIG. 3 is a view similar to FIG. 2 but taken from an opposite perspective.
Figure 4:
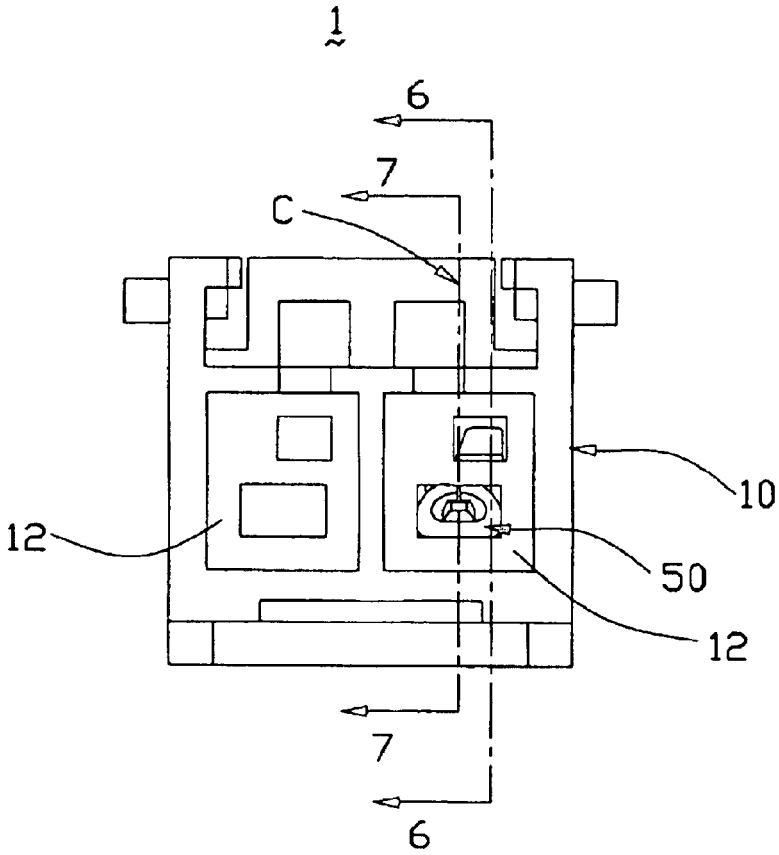
FIG. 4 is a front view of the electrical connector of the present invention.
Figure 5:
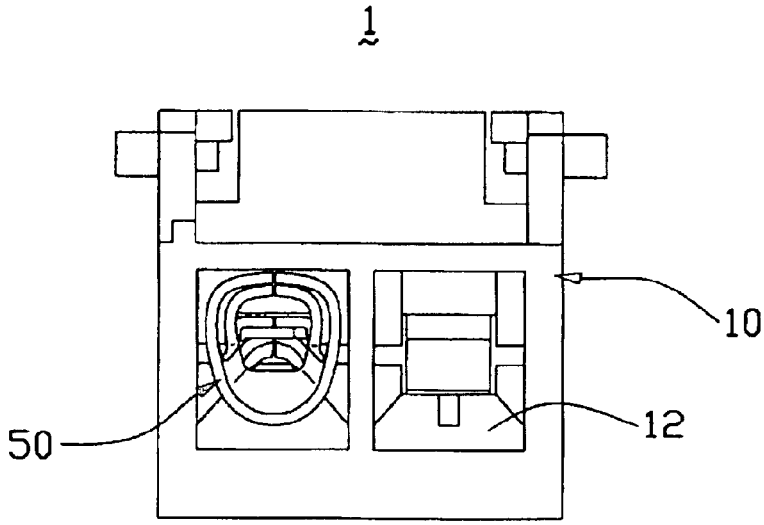
FIG. 5 is a rear view of the electrical connector of the present invention.

Referring to FIG. 1 particularly, the conductive terminal 50 is stamped and formed from a metal sheet and includes a front or mating portion 52 adapted for mating with a receptacle contact of a complementary connector (not shown), a rear or crimping portion 54 having crimping tabs 56 adapted for crimping a conductive wire (not shown), and a middle or retention portion 58 between the front and rear portions 52, 54. The front portion 52 has a slim pin for facilitating mating with the receptacle contact of the complementary connector. The middle portion 58 includes an upper strap section 60, a bottom strap section 62 and two sidewalls 64 which form a rectangular tube. An off-center latch tang 66 extends from an edge of the upper strap section 60 upwardly and rearwardly. The off-center latch tang 66 offsets from a central axis "C" of the conductive terminal 50. Between the off-center latch tang 66 and the rear portion 54 is a second upper strap section 68 which is at a same level as the upper strap section 60. A tongue portion 70 is stamped from the bottom strap section 62 downwardly and rearwardly (FIG. 7).

Figure 6:
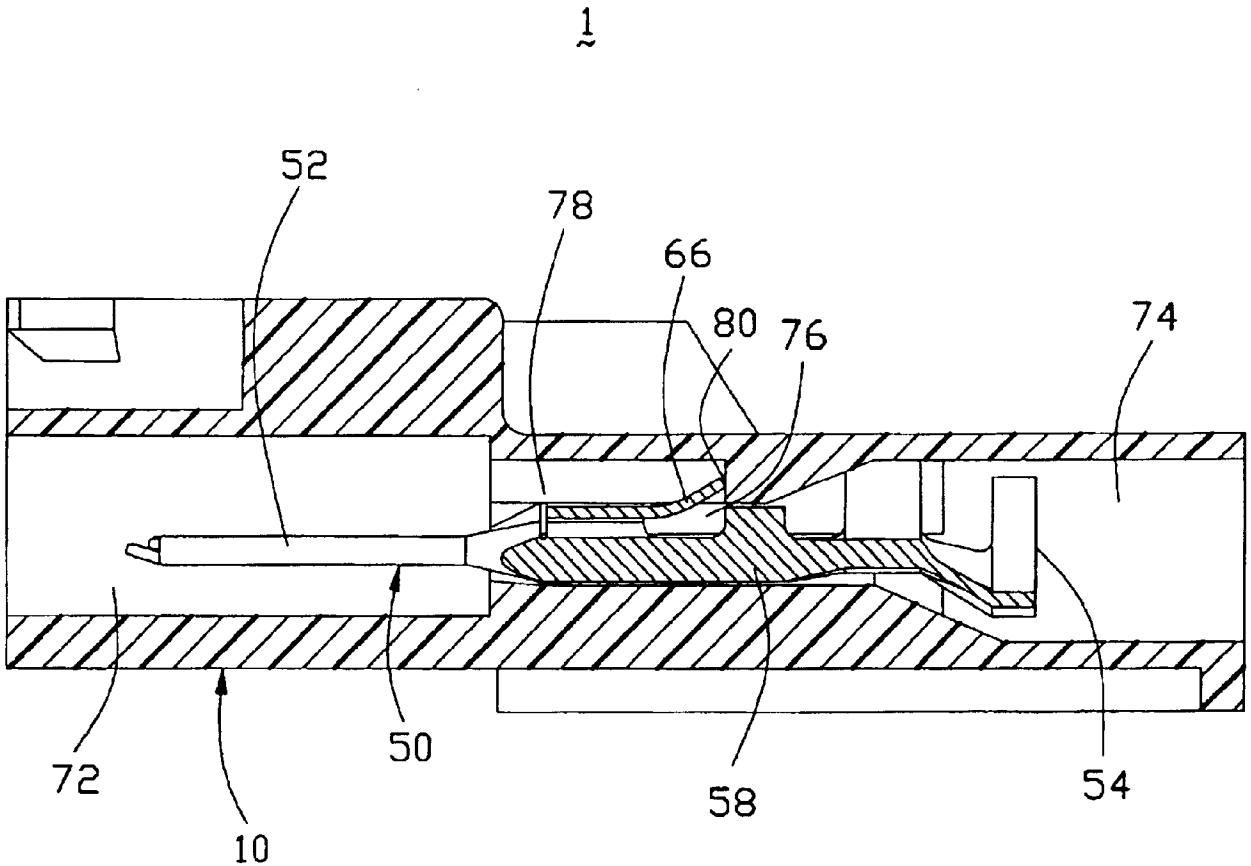
FIG. 6 is a cross-sectional view taken along line 6—6 of FIG. 4.
Figure 7:
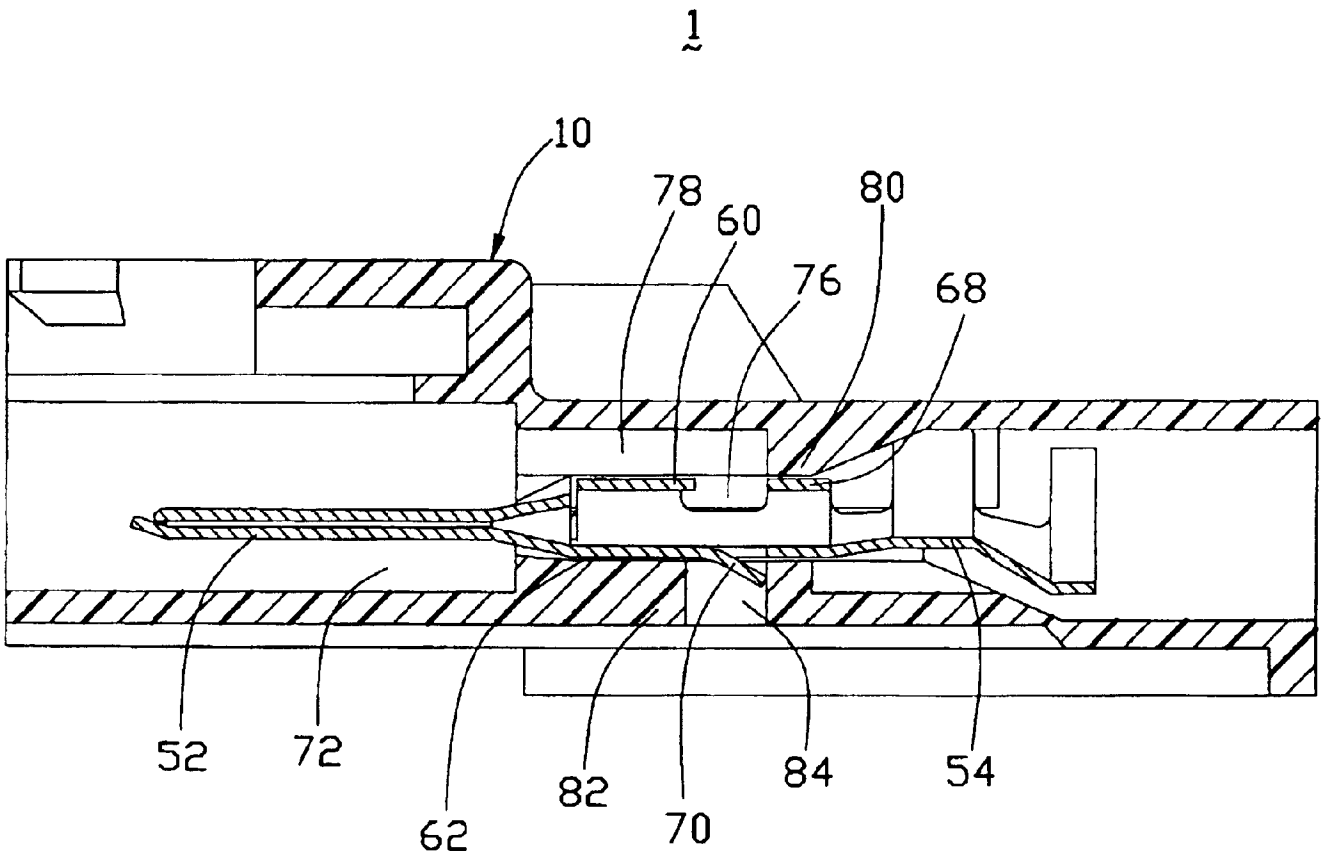
FIG. 7 is a cross-sectional view taken along line 7—7 of FIG. 4.
Figure 8:
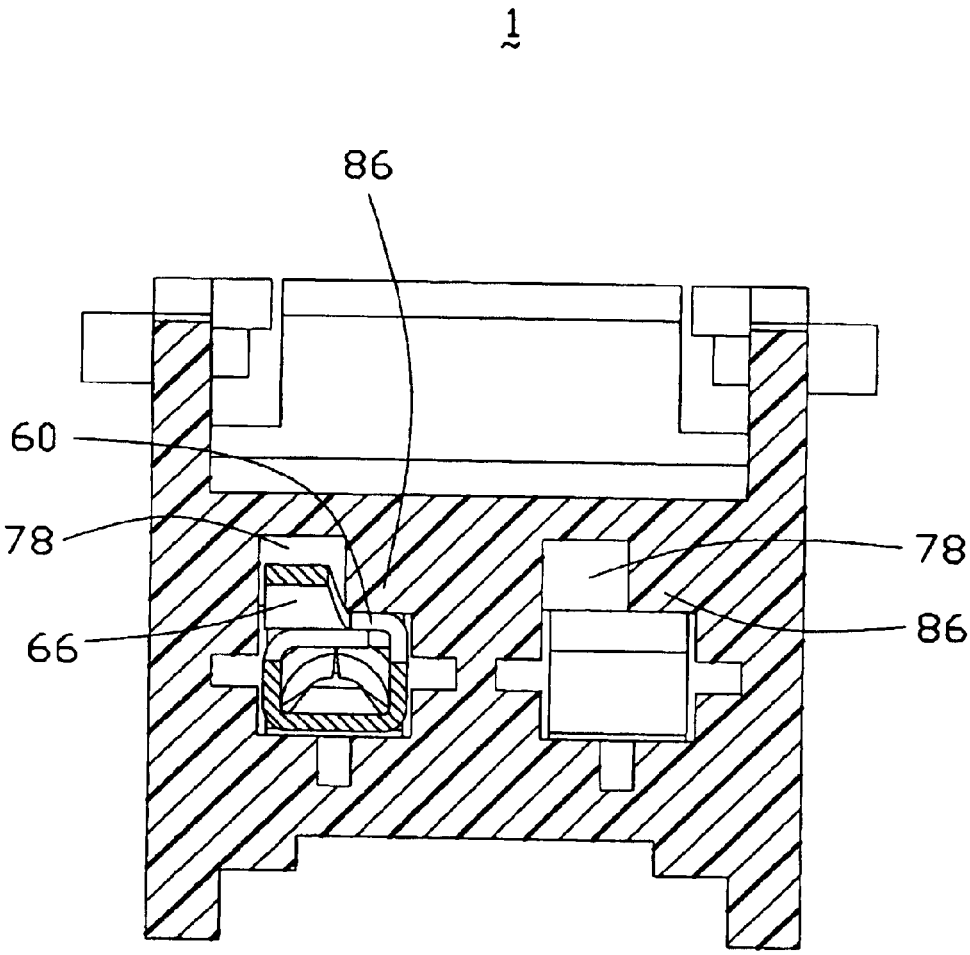
FIG. 8 is a cross-sectional view taken along line 8—8 of FIG. 3.

Referring to FIGS. 6–8, the conductive terminal 50 is held in the passageway 12 of the dielectric housing 10 via the engagement of the middle portion 60 with periphery walls of the dielectric housing 10. The passageway 12 includes a front segment 72, a rear segment 74 and a middle segment 76 respectively receiving the front portion 52, the rear portion 54 and the middle portion 58 of the conductive terminal 50. The front and rear segments 72, 74 are generally rectangular and have smooth surfaces while the middle segment 76 is bumpy. The middle segment 76 of the passageway includes an off-center recess 78 communicating with the front segment 72 but isolating from the rear segment 74 by a stopper 80. An opening 84 is defined in a bottom wall 82 of the dielectric housing 10 and communicating with the middle segment 76 of the passageway 12. The conductive terminal 50 is inserted into the passageway 12 forwardly until the latch tang 66 rearwardly bears against the stopper 80 and the tongue portion 70 rearwardly bears against a periphery wall of the opening 84 to limit reward movement of the conductive terminal 50 in the passageway 12. The second upper strap section 68 is borne by the stopper 80 and a half of the first upper strap section is borne by a block 86 of the dielectric housing 10, therefore the conductive terminal 50 is prevented from swiveling in the passageway 12 of the dielectric housing. So, the conductive terminal 50 is securely held in the passageway 12 of the dielectric housing 10.

Since the off-center latch tang 66 offsets from the central axis "C" of the conductive terminal 50 and occupies about a half of the middle portion 58 of the conductive terminal 50 near one of the sidewalls of middle portion 58, the block 86 of the dielectric housing can bear against the other half of the middle portion 58, thereof, the conductive terminal 50 is securely held in the passageway 12 of the dielectric housing 10.

It is to be understood, however, that even though numerous characteristics and advantages of the present invention have been set forth in the foregoing description, together with details of the structure and fiction of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a conductive terminal including a front portion adapted for mating with a conductive contact of a complementary connector, a rear portion having crimp tabs for electrically crimping a conductive wire and a middle portion between the front and rear portions, the middle portion having an upper strap section adjacent the front portion and an off-center latch tang extending upwardly and from the upper strap section toward the rear portion, the off-center latch tang off-setting from a central axis of the conductive terminal; and a dielectric housing defining a passageway therethrough in a rear-to-front direction thereof, the conductive terminal being received in the passageway, the passageway including an off-center recess offsetting from the central axis of the conductive terminal, the off-center latch tang of the conductive terminal being received in the off-center recess and a free end thereof bearing against the housing, the upper strap section of the conductive terminal bearing against the housing;

wherein the width of the off-center latch tang is about half of the width of the upper strap section.

2. The electrical connector as claimed in claim 1, wherein the front portion of the conductive terminal includes a slim pin portion.

3. An electrical connector comprising:

an insulative housing defining a plurality of passageways extending in a front-to-back direction;

a plurality of recesses formed in the housing in communication with the corresponding passageways in a vertical direction perpendicular to said front-to-back direction, respectively;

a plurality of terminals received in the corresponding passageways, respectively, each of said terminal including a front portion adapted to mate a complementary contact, a rear crimp portion connected to a wire, and a middle located portion between said front and rear portion, said middle portion including a pair of sidewalls with an upper strap section having two overlapped layers respectively horizontally extending from top edges of said sidewalls toward each other, a latching tang extending rearwardly from at least one of said two layers and latchably received in the corresponding recess;

wherein said latching tang is off-centered.

4. The connector as claimed in claim 3, wherein the upper strap section are at least partially pressed downwardly by the housing.

5. The connector as claimed in claim 3, further including another upper strap section positioned behind the latching tang and fully engaged with the housing.

6. The connector as claimed in claim 3, wherein said latching tang extends from an upper one of said two layers.

7. An electrical connector comprising:

a conductive terminal including a front portion adapted for mating with a conductive contact of a complementary connector, a rear portion having crimp tabs for electrically crimping a conductive wire and a middle portion between the front and rear portions, the middle portion having an upper strap section adjacent the front portion and an off-center latch tang extending upwardly and from the upper strap section toward the rear portion, the off-center latch tang off-setting from a central axis of the conductive terminal; and a dielectric housing defining a passageway therethrough in a rear-to-front direction thereof, the conductive terminal being received in the passageway, the passageway including an off-center recess offsetting from the central axis of the conductive terminal, the off-center latch tang of the conductive terminal being received in the off-center recess and a free end thereof bearing against the housing, the upper strap section of the conductive terminal bearing against the housing;

wherein the middle portion of the conductive terminal has a tongue portion downwardly and rearwardly extending from a bottom section thereof, the tongue portion being held in an opening of the dielectric housing for limiting rearward movement of the conductive terminal in the passageway of the dielectric housing.

* * * * *